US006375261B1

(12) United States Patent
Link

(10) Patent No.: US 6,375,261 B1
(45) Date of Patent: Apr. 23, 2002

(54) CHAIR

(75) Inventor: Werner Link, Messstetten (DE)

(73) Assignee: Interstuhl Bueromoebel GmbH & Co. KG, Messtetten (DE)

( * ) Notice: Subject to any disclaimer, the term of this patent is extended or adjusted under 35 U.S.C. 154(b) by 0 days.

(21) Appl. No.: 09/691,762

(22) Filed: Oct. 18, 2000

(30) Foreign Application Priority Data

Oct. 19, 1999 (DE) ..... 299 18 405 U

(51) Int. Cl.[7] ..... A47C 7/14

(52) U.S. Cl. ..... 297/284.11; 297/452.1

(58) Field of Search ..... 297/284.11, 284.1, 297/311, 452.1, 452.4; 5/653

(56) References Cited

U.S. PATENT DOCUMENTS

| | | | | | |
|---|---|---|---|---|---|
| 4,773,703 | A | * | 9/1988 | Krugener et al. | 297/284.11 X |
| 5,520,438 | A | * | 5/1996 | Stulik | 297/284.11 |
| 5,599,062 | A | * | 2/1997 | Hagedorn et al. | 297/284.11 |

FOREIGN PATENT DOCUMENTS

| | | | | |
|---|---|---|---|---|
| DE | 30 27 807 | A | 2/1982 | |
| DE | 93 00 810 | U | 5/1994 | |
| DE | 198 43 550 | A | 3/2000 | |
| EP | 0 925 745 | A | 6/1999 | |
| JP | 40628940 | * | 10/1994 | 297/284.11 |

* cited by examiner

*Primary Examiner*—Peter R. Brown
(74) *Attorney, Agent, or Firm*—Michael J. Striker

(57) ABSTRACT

A chair has a seat surface having a front region which is turned downwardly and is pullable rearwardly under the seat surface for reducing a seat depth.

6 Claims, 4 Drawing Sheets

CHAIR

BACKGROUND OF THE INVENTION

The present invention generally relates to chairs.

Modern chairs are frequently provided with seat depth adjustments, for adaptation of the seat surface of the chair to individual upper limb length of the people who have upper limb length deviating from normal sizes.

The seat depth adjustments which are presently known either have a relatively complicated construction or are not especially ergonomic during their use.

SUMMARY OF THE INVENTION

Accordingly, it is an object of present invention to provide a chair, in particular a work chair, with a seat depth adjustment means which is improved so that the seat depth adjustment has a very simple construction and is easy to operate.

In keeping with these objects and with others which will become apparent hereinafter, one feature of present invention resides, briefly stated, in a chair, in particular a work chair which has a seat surface whose front region is downwardly turned, and which under the seat surface for a reduction of the seat depth is pullable rearwardly.

Thereby the seat depth adjustment has a very simple construction and can be manufactured with low expenses.

Advantageously the front edge of the turned region is mounted on a slider which is displaced parallel to the seat surface. For easy adjustment of the seat surface by a person sifting on the chair, a rod can be mounted on the slider for forward and rearward pulling of the seat surface parallel to the front end of the seat surface. The rod can project at both sides slightly outwardly beyond the turned region of the seat surface, so that it can be used for adjustment of the seat depth simultaneously as a handle.

In order to guarantee an easy sliding of the slider arranged under the seat surface, the slider can be provided with a rod arranged under the seat surface and guided in a guide. The slider can slid especially well and without canting when it has two rods guided in at least two guides, symmetrically to a center.

For arresting the seat depth adjustment means in the desired position, the at least one rod and/or the guide can be provided with arresting elements. In an especially simple and cost-favorable manner, the arresting elements can be formed as synthetic plastic knobs or balls arranged on at least one rod or the guide, and engaging in depressions in the associated guide or rod.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
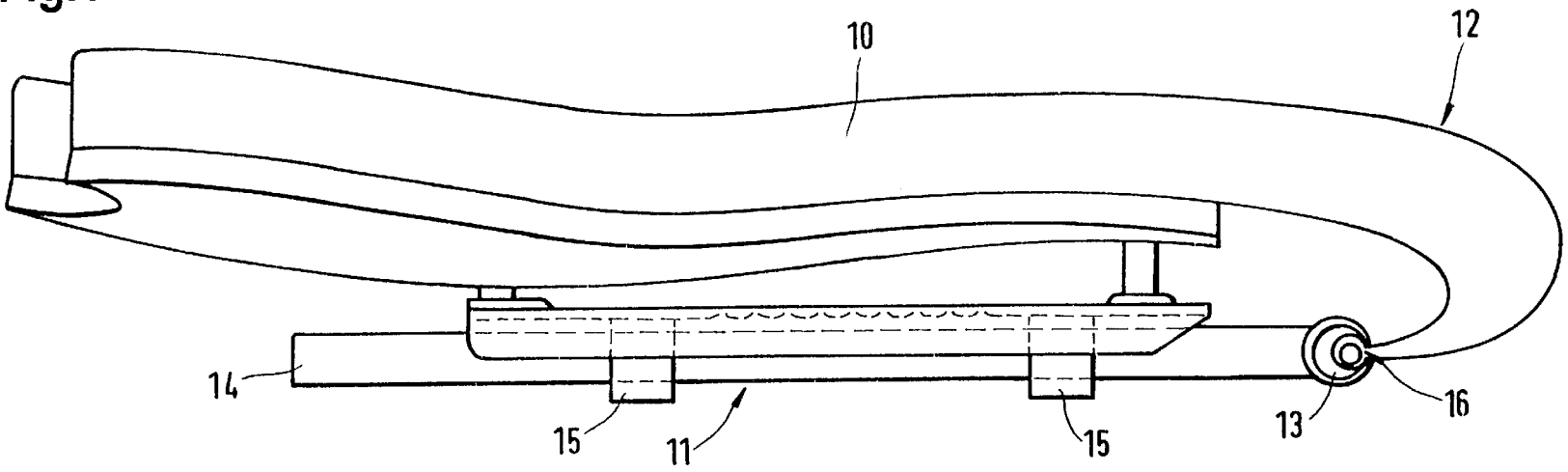
FIG. 1 is a side view of a seat surface with a seat depth adjustment from a chair according to the invention.
Figure 2:
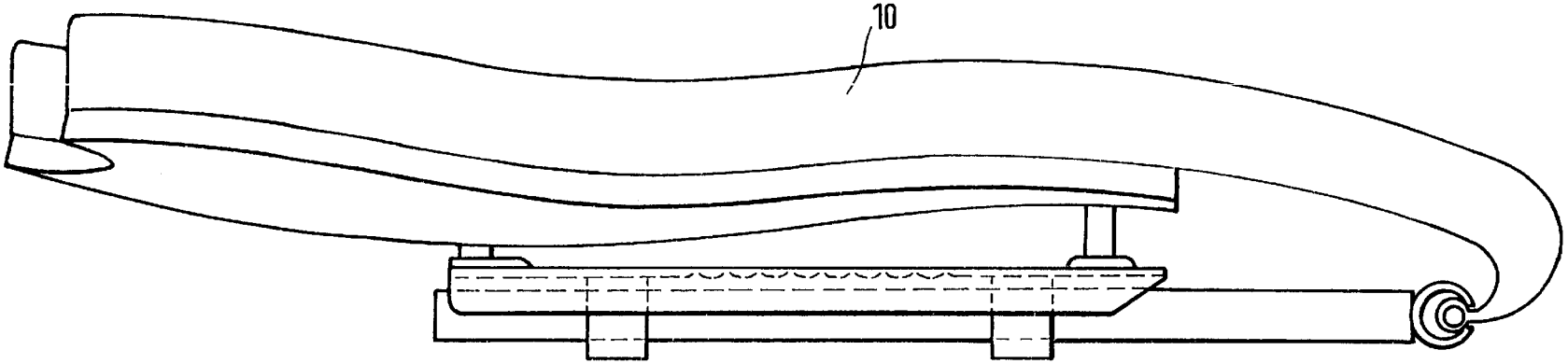
FIG. 2 is a side view of the seat surface with the seat adjustment of FIG. 1, but with a changed seating depth.

FIG. 1 shows a seat surface 10 of a not shown chair. A slider 11 is arranged on its lower side and is displaceable parallel to the seat surface 10. A front region 12 of the seat surface is downwardly turned and mounted by a rod 13 on the seat surface 10. The rod 13 has a slot 16 extending in a longitudinal direction of the rod 13. The front end of the seat .surface 10 can be inserted into the rod 13 through the slot 16. By displacing the slider 11 forwardly or rearwardly the seat surface 10 can be elongated as shown in FIG. 2 or shortened as shown in FIG. 1.

Figure 3:
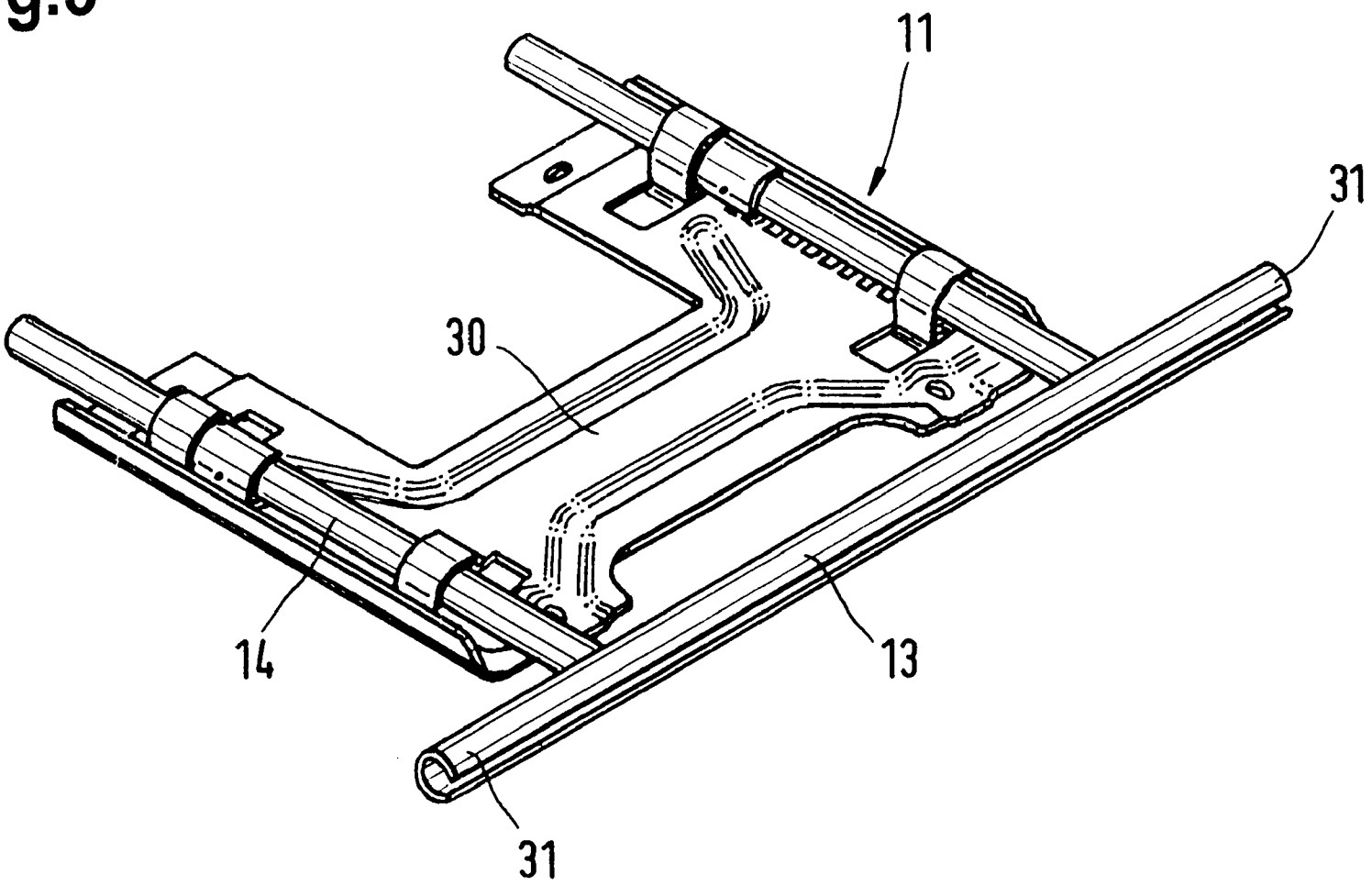
FIG. 3 is a perspective view of one embodiment of the seat depth adjustment device.
Figure 4:
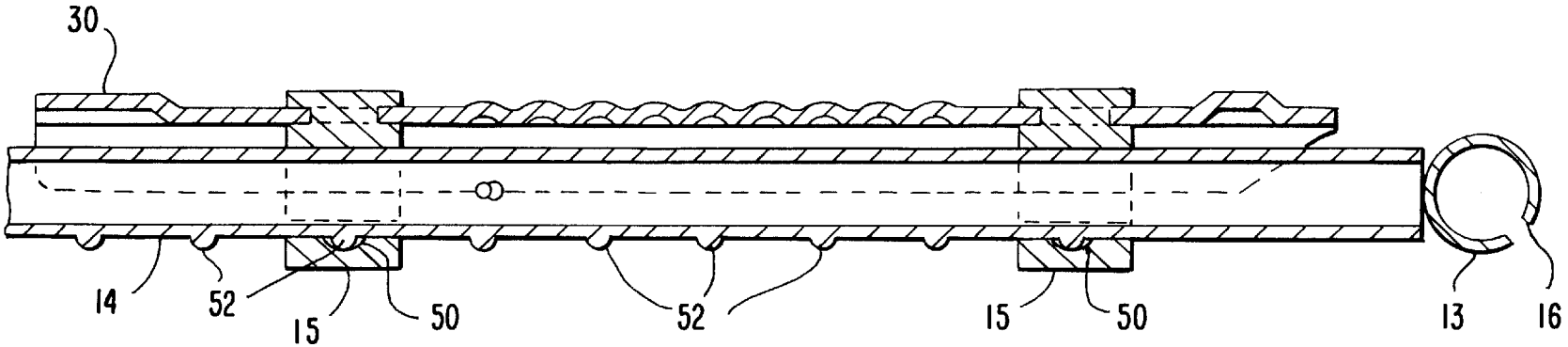
FIG. 4 is a detailed side cross-sectional view through the seat depth adjustment of FIG. 1 showing arresting element structure.
Figure 5:
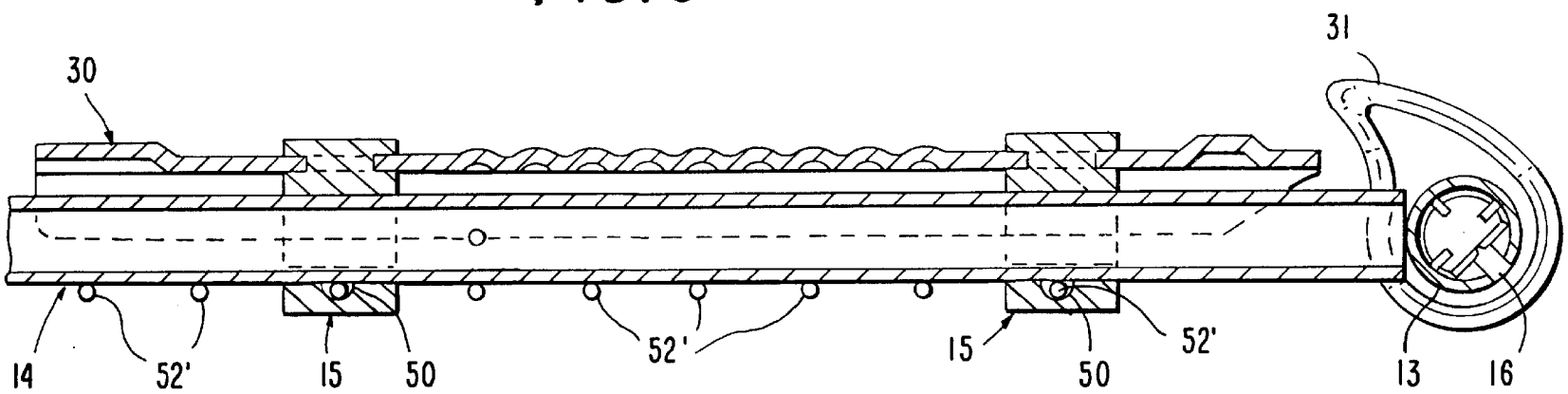
FIG. 5 is a detailed side cross-sectional view through an additional embodiment of the seat depth adjustment according to the invention, showing a different arresting element structure.

The slider 11 has two rods 14, which are guided in two guides 15 shown in FIG. 3. The guides 15 and the rods 14 are provided with arresting elements 50; 52, 52' like those shown in the embodiments of FIGS. 4 and 5. The arresting elements 50; 52, 52' are used for maintaining a desired seat depth fixed during use. In the embodiment shown in FIG. 4 the chair has a rod 14 that is not telescoping and the arresting elements comprise knobs 52 provided on the rod 14 and depressions 50 provided in the guides 15, which are engageable in each other to prevent sliding of the rod in the guides. In the additional embodiment shown in FIG. 5 instead of knobs 52, the balls 52' are provided on the rod 14. Alternatively the depressions could be provided in the rod and the guide could be provided with the knobs or balls.

FIG. 3 shows the slider 11 of FIG. 1 from below in a perspective view. The slider 11 is mounted on a base plate 30, which in turn can be mounted on the lower side of the seat surface 10 of FIG. 1. The rods 14, which are displaceable parallel to the seat surface, are telescoping in the embodiment of FIG. 3. At their one end they are connected with the rod 13. The both outwardly projecting ends of the rod 13 enable a person who sits on the chair to arbitrarily adjust the seat depth simply and without great contortions.

It will be understood that each of the elements described above, or two or more together, may also find a useful application in other types of constructions differing from the types described above.

While the invention has been illustrated and described as embodied in a chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chair comprising a seat surface, said seat surface having a front region which is turned downwardly and is pullable rearwardly under said seat surface for reducing a seat depth; a base plate mounted on a lower side of said seat surface; means for pulling said front region mounted on said base plate, said means for pulling said front region including a slider displaceable parallel to said seat surface and said downwardly turned front region of said seat surface being mounted on said slider; and an arm mounted on said slider parallel to a front end of said seat surface, said arm having a slot extending in a longitudinal direction of said arm, wherein the front end of the seat surface is insertable into said arm through said slot for pulling said seat surface forwardly and rearwardly, thereby adjusting a seat depth of said chair.

2. A chair as defined in claim 1, wherein said slider has at least one rod which is arranged under said seat surface; and further comprising a guide for guiding said rod.

3. A chair as defined in claim 2, wherein said at least one rod or said guide is provided with an arresting element and wherein a cooperating depression is formed on said at least one rod or said guide for receiving said arresting element for arresting said rod and said guide relative to one another.

4. A chair, comprising a seat surface, said seat surface having a front region which is turned downwardly and is pullable rearwardly under said seat surface for reducing a seat depth; and means for pulling said front region, wherein said means includes a slider displaceable to said seat surface, said seat surface having a turned region with a front end mounted on said slider, said slider having at least one rod arranged under said seat surface; and further comprising a guide for guiding said rod, wherein said at least one rod or said guide is provided with an arresting element and wherein a cooperating depression is formed on said at least one rod or said guide for receiving said arresting element for arresting said rod and said guide relative to one another, said arresting element formed by a plurality of members formed on said rod or said guide, which engage in the depressions of the associated guide or rod.

5. A chair, comprising a seat surface, said seat surface having a front region which is turned downwardly and is pullable rearwardly under said seat surface for reducing a seat depth; and means for pulling said front region, wherein said means includes a slider displaceable to said seat surface, said seat surface having a turned region with a front end mounted on said slider, said slider having at least one rod arranged under said seat surface; and further comprising a guide for guiding said rod, wherein said at least one rod or said guide is provided with an arresting element and wherein a cooperating depression is formed on said at least one rod or said guide for receiving said arresting element for arresting said rod and said guide relative to one another, said arresting element formed by a plurality of members formed on said rod or said guide, which engage in the depressions of the associated guide or rod, said members formed as synthetic plastic knobs.

6. A chair, comprising a seat surface, said seat surface having a front region which is turned downwardly and is pullable rearwardly under said seat surface for reducing a seat depth; and means for pulling said front region, wherein said means includes a slider displaceable to said seat surface, said seat surface having a turned region with a front end mounted on said slider, said slider having at least one rod arranged under said seat surface; and further comprising a guide for guiding said rod, wherein said at least one rod or said guide is provided with an arresting element and wherein a cooperating depression is formed on said at least one rod or said guide for receiving said arresting element for arresting said rod and said guide relative to one another, said arresting element formed by a plurality of members formed on said rod or said guide, which engage in the depressions of the associated guide or rod, said members formed by a plurality of balls.

* * * * *